US008072143B2

(12) United States Patent
Asano et al.

(10) Patent No.: US 8,072,143 B2
(45) Date of Patent: Dec. 6, 2011

(54) PLASMA DISPLAY PANEL AND ITS MANUFACTURING METHOD

(75) Inventors: Hiroshi Asano, Osaka (JP); Takahiro Hamada, Osaka (JP); Seigo Shiraishi, Osaka (JP)

(73) Assignee: Panasonic Corporation, Osaka (JP)

( * ) Notice: Subject to any disclaimer, the term of this patent is extended or adjusted under 35 U.S.C. 154(b) by 203 days.

(21) Appl. No.: 12/375,295

(22) PCT Filed: Mar. 12, 2008

(86) PCT No.: PCT/JP2008/000543

§ 371 (c)(1),
(2), (4) Date: Apr. 2, 2009

(87) PCT Pub. No.: WO2008/129775

PCT Pub. Date: Oct. 30, 2008

(65) Prior Publication Data

US 2009/0309496 A1 Dec. 17, 2009

(30) Foreign Application Priority Data

Mar. 19, 2007 (JP) ..... 2007-070152
Jul. 2, 2007 (JP) ..... 2007-174433

(51) Int. Cl.
*H01J 17/49* (2006.01)

(52) U.S. Cl. ..... 313/586; 445/25

(58) Field of Classification Search ..... 313/582–586
See application file for complete search history.

(56) References Cited

U.S. PATENT DOCUMENTS

| | | | | |
|---|---|---|---|---|
| 6,242,864 | B1 | 6/2001 | Nakahara et al. | |
| 2005/0264487 | A1 | 12/2005 | Tokunaga et al. | |
| 2006/0012721 | A1 | 1/2006 | Morita et al. | |
| 2006/0164013 | A1 * | 7/2006 | Park | 313/587 |
| 2006/0284559 | A1 | 12/2006 | Naoi et al. | |
| 2007/0269675 | A1 * | 11/2007 | Ichiki et al. | 428/603 |
| 2008/0174979 | A1 | 7/2008 | Furihata et al. | |
| 2010/0096986 | A1 * | 4/2010 | Tsujita et al. | 313/582 |

FOREIGN PATENT DOCUMENTS

| | | |
|---|---|---|
| JP | 64-28273 | 1/1989 |
| JP | 8-236028 | 9/1996 |
| JP | 9-141348 | 6/1997 |
| JP | 10-334809 | 12/1998 |
| JP | 2003-303547 | 10/2003 |
| JP | 2005-343758 | 12/2005 |
| JP | 2006-54158 | 2/2006 |
| JP | 2006-147417 | 6/2006 |
| JP | 2006-173018 | 6/2006 |
| JP | 2007-35655 | 2/2007 |
| JP | 2007-254269 | 10/2007 |
| WO | 2005/118504 | 12/2005 |

* cited by examiner

*Primary Examiner* — Bumsuk Won
*Assistant Examiner* — Brenitra Lee

(57) ABSTRACT

A PDP and a manufacturing method for the PDP are provided, the PDP being capable of suppressing discharge delay due to improved discharge properties of a protective layer, and exhibiting superior image display performance despite having a high-definition cell structure. A magnesium oxide powder layer (16) is formed by distributing magnesium oxide particles (16*a*) flatly on a surface layer (8). Each of the magnesium oxide particles (16*a*) includes halogen atoms at and in a vicinity of the surface thereof. The magnesium oxide particles (16*a*) are manufactured such that the halogen atoms exist particularly at the surface of each of magnesium oxide particles (16*a*) through to a depth of 4 nm or less toward the core of each of the magnesium oxide particles (16*a*).

8 Claims, 5 Drawing Sheets

PLASMA DISPLAY PANEL AND ITS MANUFACTURING METHOD

TECHNICAL FIELD

The present invention relates to a plasma display panel and a manufacturing method therefor, and in particular to a plasma display panel having a magnesium oxide protective layer and a manufacturing method for such plasma display panel.

BACKGROUND ART

Plasma display panels (hereinafter referred to as PDPs) are a type of flat screen device that is capable of high speed display and can also easily be made in large sizes. As such, PDPs are widely used in a wide variety of fields such as image display apparatuses and advertisement display apparatuses.

FIG. 10 shows a schematic elevation of the structure of a discharge cell that is a unit of discharge in a general AC PDP. A PDP 1*x* shown in FIG. 10 is composed of a front panel 2 and a back panel 9 sealed together. The front panel 2 includes a front panel glass 3. A plurality of display electrode pairs 6 each composed of a scan electrode 5 and a sustain electrode 4 are disposed on the surface of the front panel glass 3. A dielectric layer 7 and a surface layer 8 are layered in the stated order to cover the display electrode pairs 6. The scan electrode 5 and the sustain electrode 4 are composed of respective transparent electrodes 51 and 41 and bus lines 52 and 42 layered together.

The dielectric layer 7 is made of low-melting glass having a softening point of approximately 550 C.° to 600 C.°, and has a current limiting function that is peculiar to AC PDPs.

The surface layer 8 protects the dielectric layer 7 and the display electrode pairs 6 from ion bombardment caused by plasma discharge. The surface layer 8 also efficiently emits secondary electrons and lowers firing voltage. Generally, magnesium oxide (MgO) that has high secondary electron emission properties, high sputtering resistance, and high optical transparency is used to form the surface layer 8 with a thickness of approximately 0.5 μm to 1 μm using a vacuum deposition method (Patent Documents 1 and 2) or a printing method (Patent Document 3). Note that a protective layer that has the identical structure to the surface layer 8 may be provided in order to ensure secondary electron emission properties and to protect the dielectric layer 7 and the display electrode pairs 6.

The back panel 9 includes a back panel glass 10 and a plurality of data (address) electrodes 11 disposed thereon so as to intersect the display electrode pairs 6 substantially at a right angles. The data electrodes 11 are used for writing image data in the discharge cells. On the back panel glass 10, a dielectric layer 12 made of low-melting glass is disposed to cover the data electrodes 11. Disposed at boundaries between adjacent discharge cells (not illustrated) on the dielectric layer 12 at a predetermined height are barrier ribs 13 made of low-melting glass. More specifically, the barrier ribs 13 are composed of pattern parts 1231 and 1232 that combine to form a lattice pattern to partition a discharge space 15 into the plurality of discharge cells. Phosphor ink of red (R), green (G) and blue (B) is applied to the surface of the dielectric layer 12 and the lateral surfaces of the barrier ribs 13, and baked to form phosphor layers 14 (phosphor layers 14R, 14G and 14B).

The front panel 2 and the back panel 9 are sealed together at edge portions thereof such that the display electrode pairs 6 are orthogonal to the data electrodes 11 via the discharge space 15. In the sealed discharge space 15, a rare gas mixture such as Xe—Ne or Xe—He is enclosed as a discharge gas at some tens of kilopascals. This how the PDP 1*x* is structured.

In order to display an image on the PDP, the method employed is one that expresses gradations in an image by dividing one field of the image into a plurality of subfields (S.F.) (e.g. intra-field time division grayscale display method).

In view of the need for PDPs to be capable of high-definition display (for full spec high vision television and the like) and to be driven at high speed, research into improving discharge properties of PDPs is being widely carried out. One of the important issues addressed by such research is the prevention and suppression of "discharge delay".

Discharge delay is a phenomenon of a lag from the rising edge of the driving pulse to when discharge occurs when the PDP is driven at high speed with a narrowed driving pulse. When there is a significant occurrence of discharge delay, discharge becomes less likely to be completed within the width of the applied pulse. As a result, there is a risk that some cells will not be addressed properly, and will therefore fail to light. The likelihood of discharge delay occurring in a cell structure for high-definition display is particularly marked when the PDP is driven at high speed. There is a desire to find a solution to the problem of discharge delay as soon as possible.

The cause of discharge delay is thought to lie principally in the properties of the protective layer. One response has been to attempt to improve the discharge properties of the protective layer by adding a dopant such as Fe, Cr and V or a dopant such as Si and Al to the MgO (Patent Documents 1 and 2). Another response has been to attempt to improve discharge properties of the surface of the protective layer by manufacturing single-crystal particles of MgO using a gas phase method, and providing a layer of the single crystal particles either directly on the dielectric layer, or via an MgO film formed using a thin film method (Patent Document 3). The method disclosed by Patent Document 3 achieves some reduction in discharge delay at low temperature.

Patent Document 1: Japanese Unexamined Patent Application Publication No. H08-236028

Patent Document 2: Japanese Unexamined Patent Application Publication No. H10-334809

Patent Document 3: Japanese Unexamined Patent Application Publication No. 2006-173018

Patent Document 4: Japanese Unexamined Patent Application Publication No. 2006-147417

Patent Document 5: Japanese Unexamined Patent Application Publication No. S64-28273

DISCLOSURE OF THE INVENTION

Problems to be Solved by the Invention

However, the reality is that none of the conventional techniques recited by the above patent documents sufficiently resolves the problem of discharge delay.

For instance, while the technique of Patent Document 3 uses fine Mgo particles (powder) manufactured using a gas-phase method, particles made using a gas-phase method are relatively inconsistent in diameter, with the powder containing both particles having a relatively large diameter and numerous fine particles. However, among the numerous fine particles are particles that do not make any real contribution to preventing or suppressing discharge delay, and therefore unless a relatively large number of the MgO particles is not used in the PDP, no actual effect of suppressing discharge delay will be achieved.

However, an excessive amount of fine MgO particles provided on the dielectric layer or on the surface layer will cause scattering of visible light generated by the phosphor. Scattering of the visible light gives rise to the problem of reduction in visible light transmittance.

One method that has been proposed to resolve these problems is to sort the MgO fine particles in order to remove those having a small diameter (Patent Document 4). However if the MgO particles are to be sorted, a sorting process must be added to the manufacturing process. In addition to the increased number of processes lowering manufacturing efficiency, there is also the significant problem of the need for a sorting machine. Furthermore, in terms of manufacturing cost various other problems arise, such as the waste MgO material that cannot be used after the sorting process.

In view of the described problems, it is thought that increase in discharge delay in PDPs has not been effectively solved in practical terms. Given that the likelihood of the problem of discharge delay occurring in particularly marked when a PDP having a fine cell structure for full spec high vision television or the like is driven at high speed, there is a desire to find a solution to the problem of discharge delay as soon as possible.

The present invention was conceived in view of the stated problems, and has an object of providing a PDP, and a manufacturing method therefor, in which discharge delay can be suppressed by improving discharge properties of a protective layer, and that achieves has superior image display performance with a fine cell structure for high definition display.

Means to Solve the Problems

In order to solve the stated problems, the present invention is a plasma display panel including a first substrate and a second substrate that face each other via a discharge space, and an electrode and a dielectric layer provided on a main surface of the first substrate that faces the second substrate, the first substrate and the second substrate being sealed together at edges thereof, wherein the first substrate has magnesium oxide powder located either directly or indirectly on a surface of the dielectric layer such that the magnesium oxide powder faces the discharge space, the magnesium oxide powder being composed of magnesium oxide particles that include halogen atoms, and a ratio of the halogen atoms to magnesium atoms in the magnesium oxide particles being in a range of 6.12 atm % to 21.99 atm %, inclusive.

Furthermore, the ratio of the halogen atoms to the magnesium atoms may be in a range of 6.12 atm % to 19.30 atm %, inclusive.

Furthermore, the plasma display panel may further include a surface layer on the surface of the dielectric layer, the magnesium oxide powder being located on a surface of the surface layer that faces the discharge space, the surface layer being made of at least one metal oxide selected from magnesium oxide, calcium oxide, barium oxide and strontium oxide.

Furthermore, the halogen atoms in each magnesium oxide particle may exist at least in an area extending from a surface of the magnesium oxide particle through to a depth in a vicinity of the surface of the magnesium oxide particle.

Here, the depth in the vicinity of the surface may be a depth of 4 nm or less from the surface toward a core of the magnesium oxide particle.

Furthermore, the halogen atoms may, specifically, be one of fluorine atoms and chlorine atoms.

Here, the magnesium oxide powder may have a projected area ratio of 1.0% to 31.5%, inclusive, with respect to the dielectric layer.

Furthermore, the present invention is a manufacturing method for a plasma display panel, the manufacturing method including: a magnesium oxide particle provision step of providing magnesium oxide particles on a surface of a dielectric layer, the dielectric layer being provided together with an electrode on a surface of the first substrate; and a sealing step of arranging the first substrate and second substrate such that the surface of the first substrate faces the second substrate, and sealing the first substrate and the second substrate together, wherein the magnesium oxide particles used in the magnesium oxide particle provision step are obtained by baking a material composed of a magnesium oxide precursor and a sintering agent, the sintering agent being at least one of magnesium fluoride, magnesium chloride, aluminium fluoride, calcium fluoride, lithium fluoride and sodium chloride, and a ratio of the halogen atoms to magnesium atoms in the magnesium oxide particles is in a range of 6.12 atm % to 21.99 atm %, inclusive.

Furthermore, the present invention is a manufacturing method for a plasma display panel, the manufacturing method including: a surface layer formation step of forming a surface layer on a surface of a dielectric layer, the dielectric layer being provided together with an electrode on a surface of the first substrate; and a sealing step of arranging the first substrate and second substrate such that the surface of the first substrate faces the second substrate, and sealing the first substrate and the second substrate together, wherein the manufacturing method further comprises, between the surface layer formation step and the sealing step, a magnesium oxide particle provision step of providing magnesium oxide particles on a surface of the surface layer that faces the second substrate, wherein, in the surface layer formation step, the surface layer is formed from at least one metal oxide selected from magnesium oxide, calcium oxide, barium oxide and strontium oxide, the magnesium oxide particles used in the magnesium oxide particle provision step are obtained by baking a material composed of a magnesium oxide precursor and a sintering agent, the sintering agent being at least one of magnesium fluoride, magnesium chloride, aluminium fluoride, calcium fluoride, lithium fluoride and sodium chloride, and a ratio of the halogen atoms to magnesium atoms in the magnesium oxide particles is in a range of 6.12 atm % to 21.99 atm %, inclusive.

Effects of the Invention

In a PDP having the stated structure, MgO particles that include halogen atoms have a high secondary electron emission coefficient $\gamma$ compared to particles that include only MgO. Due to the existence of the halogen atoms, secondary electrons are emitted abundantly from the MgO particles into the discharge space when the PDP of the present invention is driven. As a result, discharge delay can be appropriately suppressed, with discharge being started using a conventional level of firing voltage.

This effect of suppressing discharge lag is achieved due to the material properties of an extremely shallow area from the surface through to a depth of several hundred pm in each MgO particles.

Furthermore, the present invention achieves the above effect sufficiently even without the cover rate of the MgO powder layer with respect to the surface layer or the dielectric layer being especially high. Therefore, the MgO powder layer can be relatively thin, thus ensuring favorable visible light transmittance of the front panel. As a result, the present invention achieves suppression of discharge delay coupled with superior image display performance.

Furthermore, as a result of baking the MgO precursor, the present invention obtains MgO particles having an even diameter compared to conventional techniques, and therefore eliminates the need for a sorting process to remove particles that do not contribute to prevention and suppression of discharge delay. In other words, the generated MgO particles can be used as is. The elimination of the sorting process simplifies the overall manufacturing process, having considerable advantages in terms of manufacturing efficiency and cost. Furthermore, the MgO particles can be manufactured using a general, conventional ceramic powder manufacturing process, and therefore manufacturing costs can be effectively suppressed.

| Description of Numerical References | |
|---|---|
| 1, 1a, 1x | PDP |
| 2 | Front panel |
| 3 | Front panel glass |
| 4 | Sustain electrode |
| 5 | Scan electrode |
| 6 | Display electrode pair |
| 7, 12 | Dielectric layer |
| 8 | Surface layer |
| 9 | Back panel |
| 10 | Back panel glass |
| 11 | Data (address) electrode |
| 13 | Barrier rib |
| 14 | Phosphor layer |
| 15 | Discharge layer |
| 16a | MgO particles |
| 16 | MgO powder layer composed of MgO particles including halogen atoms |
| 17 | Protective layer |

BEST MODE FOR CARRYING OUT THE INVENTION

The following describes preferred embodiments and examples of the present invention. Note that the present invention is by no means limited to these, and various changes may be made as appropriate without departing from the technical scope of the present invention.

First Embodiment (Structure of PDP)

Figure 1:
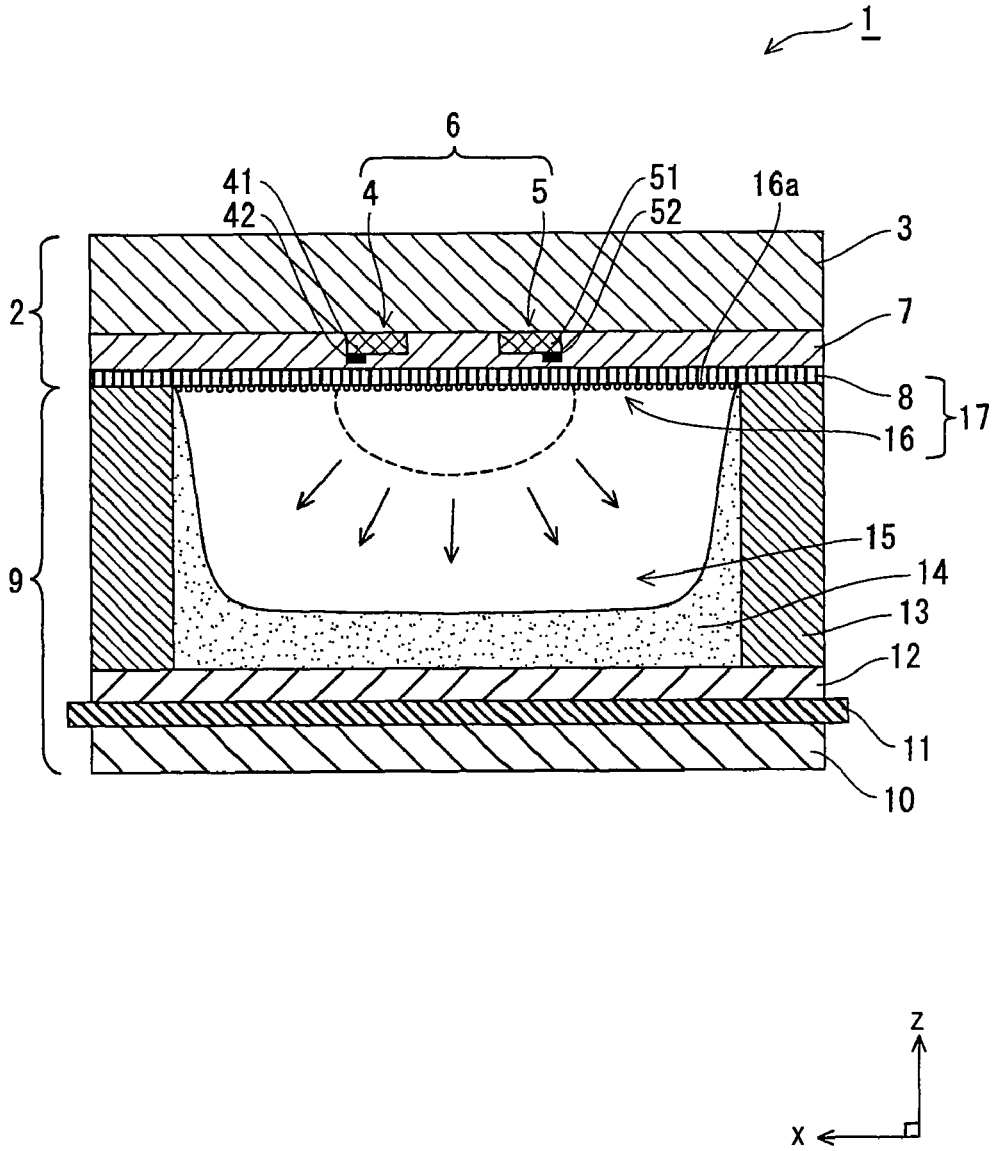
FIG. 1 is a cross-sectional view of the structure of a PDP of a first embodiment of the present invention.

FIG. 1 is a schematic sectional view of a PDP 1 in accordance with the first embodiment of the present invention, the section being taken along the x-z plane. The structure of the PDP 1 is basically identical to that of a conventional PDP (FIG. 10) except for the structure of and around the protective layer. It should be noted that an MgO powder layer 16 provided on the surface of the surface layer 8 is illustrated in a schematic manner, and appears larger than in reality.

The PDP 1 is an AC PDP with a 42-inch screen having 1024×768 (pixels) in conformity with the NTSC specification. The present invention may be, of course, applied to other specifications such as XGA and SXGA. The applicable specifications of the high-definition PDP that is able to display images at a higher resolution than an HD (high-definition) PDP are PDPs with a size of 37, 42, and 50 inches having 1024×720 (pixels), 1024×768 (pixels), and 1366×768 (pixels), respectively. In addition, such a PDP is also applicable to display images at higher resolution than the PDP 1. Examples of a PDP having higher-definition pixels than the HD PDP include a full HD PDP with 1920×1080 (pixels).

As shown in FIG. 1, roughly speaking the PDP 1 is composed of a first substrate (front panel 2) and a second substrate (back panel 9) that oppose each other with a main surface of the first substrate facing a main surface of the second substrate.

The front panel 2 includes a front panel glass 3 as its substrate. On one main surface of the front panel glass 3, a plurality of electrode pairs 6 (each composed of a scan electrode 5 and a sustain electrode 4) are each disposed with a given discharge gap (75 μm) therebetween. Each electrode is composed of transparent electrode 51 or 41 and bus line 52 or 42 layered thereon. The transparent electrodes 51 and 41 in a stripe pattern (each transparent electrode is 0.1 μm thick, 150 μm wide) are made of transparent conductive materials such as indium tin oxide (ITO), zinc oxide (ZnO), and tin oxide ($SnO_2$). The bus lines 52 and 42 (7 μm thick, 95 μm wide) are made of an Ag thick film (2 μm to 10 μm thick), an Al thin film (0.1 μm to 1 μm thick), a Cr/Cu/Cr layered thin film (0.1 μm to 1 μm thick) or the like. These bus lines 52 and 42 reduce the sheet resistance of the transparent electrodes 51 and 41.

The term "thick film" refers to a film that is formed according to any of various kinds of thick-film processes in which a film is formed by applying a paste and the like containing the conductive materials and baking the paste. The term "thin film" refers to a film that is formed according to any of various kinds of thin-film processes using vacuum processing such as a sputtering method, ion plating method, or electron-beam deposition method.

On the entire surface of the front panel glass 3 where the display electrode pairs 6 are disposed, a dielectric layer 7 is formed with use of a screen printing method. The dielectric layer 7 is made of low-melting glass (approximately 30 μm thick) that contains lead oxide (PbO), bismuth oxide ($Bi_2O_3$) or phosphorus oxide ($PO_4$) as the principal component.

The dielectric layer 7 has a current limiting function that is peculiar to AC PDPs, which is why AC PDPs can realize a longer life than DC PDPs.

On the surface of the dielectric layer 7 that faces the discharge space, the surface layer 8 with a thickness of approximately 1 μm is layered. The MgO powder layer 16 is disposed on the surface of the surface layer 8. The surface layer 8 and the MgO powder layer 16 constitute a protective layer 17 disposed on the dielectric layer 7.

The surface layer 8 is a thin film to protect the dielectric layer 7 from ion bombardment during discharge, and also efficiently discharges secondary electrons, and has a role of lower a firing voltage. The surface layer 8 is made of MgO material that has high sputtering resistance and a high secondary electron emission coefficient γ. The MgO material used in the embodiments of the present invention has favorable optical transparency and electric insulation properties.

The MgO powder layer 16 is made up of MgO particles 16*a* having MgO as a main component, and fluorine atoms as halogen atoms. Details of the MgO powder layer 16 are given later.

On the main surface of the back panel glass 10 that is the substrate of the back panel 9, data electrodes 11 each with a width of 100 μm are formed in a stripe pattern having a gap (360 μm) therebetween in the y direction and extending longitudinally in the x direction. The data electrodes 11 are made up of any one of an Ag thick film (2 μm to 10 μm thick), an Al thin film (0.1 μm to 1 μm thick), a Cr/Cu/Cr layered thin film (0.1 μm to 1 μm thick) and the like. The dielectric layer 12 with a thickness of 30 μm is disposed on the entire surface of the back panel glass 9 to cover the data electrodes 11.

On the dielectric layer 12, the barrier ribs 13 (approximately 110 μm high and 40 μm wide) are each disposed in a lattice pattern above the gaps between adjacent data electrodes 11. The barrier ribs 13 prevent erroneous discharge or optical crosstalk by partitioning the discharge cells.

On the lateral surfaces of the barrier ribs 13 and on the surface of the dielectric layer 12 between the lateral surfaces, phosphor layers 14 of red (R), green (G) and blue (B) for color display are formed. Possible compositions of each of the phosphor layers include the following: commonly known BAM:Eu as the blue (B) phosphor, (Y, Gd)$BO_3$:Eu or $Y_2O_3$:Eu as the red phosphor (R), and $Zn_2SiO_4$:Mn, $YBO_3$:Tb, or (Y, Gd)$BO_3$:Tb as the green phosphor (G).

Note that the dielectric layer 12 is not essential to the PDP, and that the phosphor layer 14 may directly cover the data electrodes 11.

The front panel 2 and the back panel 9 are disposed such that the data electrodes 11 and the display electrode pairs 6 are orthogonal to each other in plan view. The edge portions around the panels 2 and 9 are sealed with glass frit. In the space between the panels 2 and 9, a discharge gas composed of inert gases such as He, Xe and Ne is enclosed at a given pressure.

Between the barrier ribs 13 is a discharge space 15. Where the adjacent display electrode pair 6 intersects the data electrode 11 via the discharge space 15 corresponds to a discharge cell (also referred to as a "sub-pixel") that functions to display images. The discharge cell pitch is 675 μm in the x direction and 300 μm in the y direction. Three of the adjacent discharge cells whose colors are red, green and blue compose one pixel (675 μm×900 μm).

Figure 2:
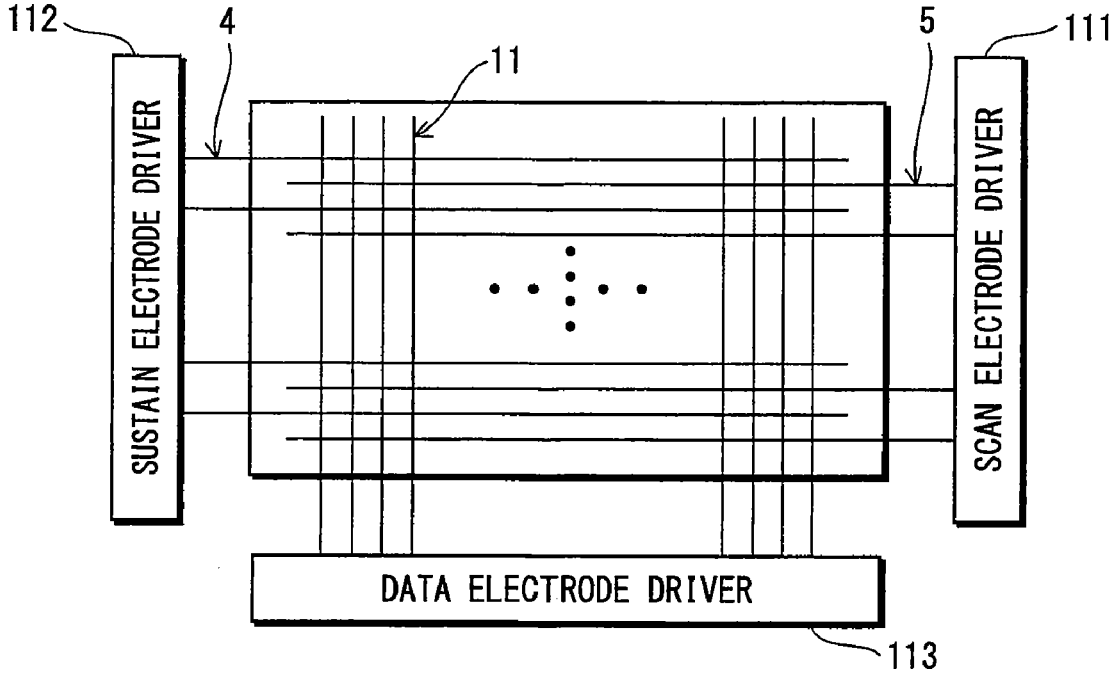
FIG. 2 is a schematic view of the relationship between electrodes and drivers.

As shown in FIG. 2, the scan electrodes 5, the sustain electrodes 4 and the data electrodes 11 are electrically connected to a scan electrode driver 111, a sustain electrode driver 112 and a data electrode driver 113 that are included in a driving circuit around the edges of the panel in the x and y directions. Here, there is one connection connecting all of the sustain electrodes 4 to the sustain electrode driver 113, while each scan electrode 5 and each data electrode 11 is connected independently to the respective one of the scan electrode driver 111 and the data electrode driver 113.

(Driving of PDP)

Upon driving commencing, a commonly known driving circuit (not illustrated) including the drivers 111 to 113 applies an AC voltage in a range of tens to hundreds of kilohertz between the display electrode pairs 6 to selectively generate discharge in arbitrary discharge cells. As a result, ultraviolet rays (shown as the dotted lines and the arrows in FIG. 1) including resonance lines with wavelengths of mainly 147 nm emitted by the excited Xe atoms and molecular lines with wavelengths of mainly 172 nm emitted by the excited Xe molecules irradiate the phosphor layers 14. Accordingly, the phosphor layers 14 are excited to emit visible light. The visible light transmits the front panel 2, and radiates through the front panel 2.

One example of the driving method employed is the intra-field time division grayscale display method. This method divides one field of an image into a plurality of subfields (S.F.), and further divides each subfield into a plurality of periods. One subfield is divided into four periods: (1) an initialization period in which all discharge cells are reset; (2) an address period in which discharge cells are selectively addressed for display according to input data; (3) a sustain period in which a sustain discharge is generated in the discharge cells that are addressed to display the images; and (4) an erase period in which wall charges generated by the sustain discharge are erased.

In each subfield, the following occurs so that the PDP 1 emits light to display an image. In the initialization period, an initialization pulse resets wall charges in all discharge cells of the entire panel. In the address period, an address discharge is generated in the discharge cells that are intended to light. Subsequently in the sustain period, an AC voltage (sustain voltage) is applied to all the discharge cells simultaneously. Thus, the sustain discharge is generated in the given length of time so as to display the image.

Figure 3:
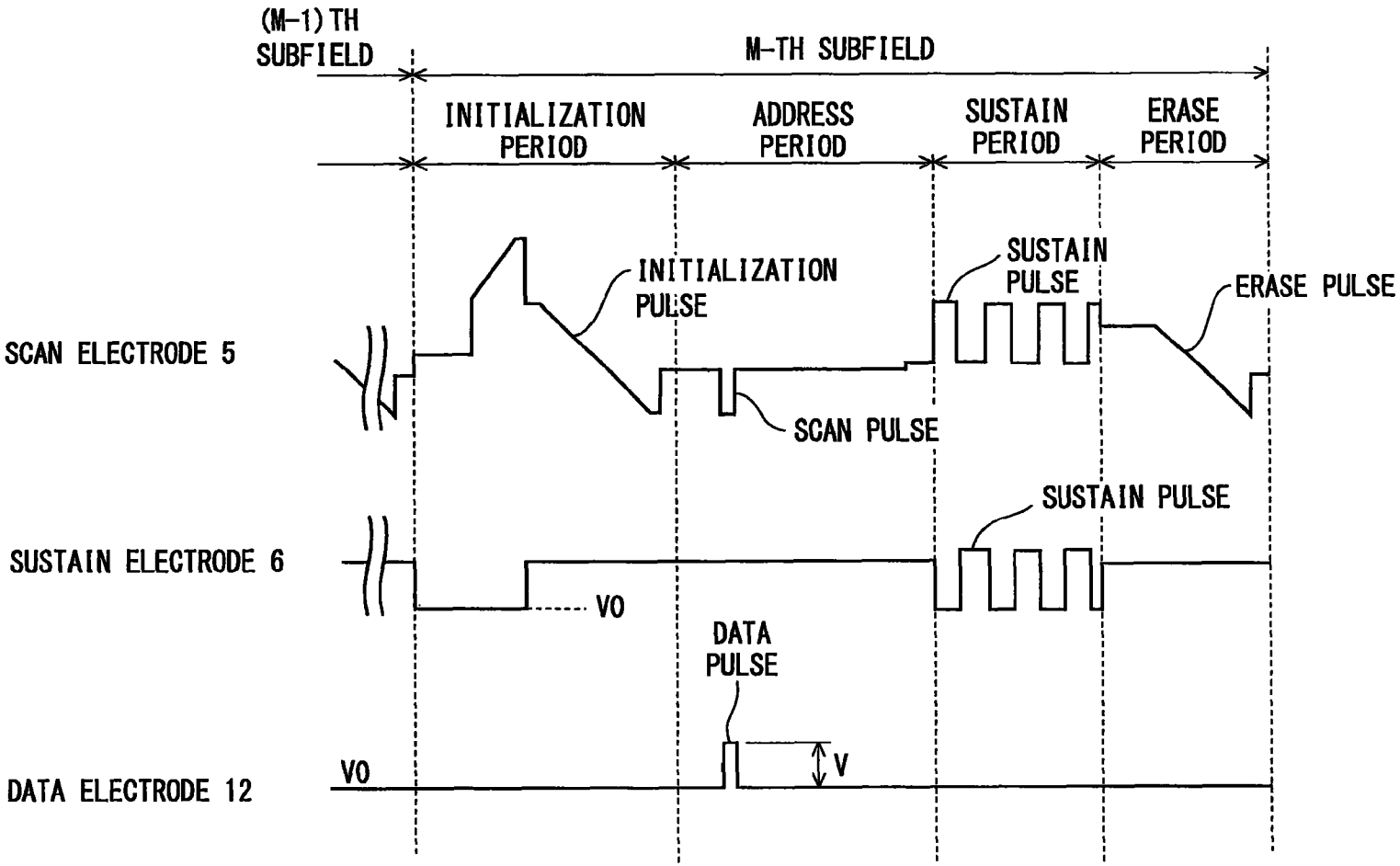
FIG. 3 shows an example of driving waveforms in the PDP.

FIG. 3 shows an example of driving waveforms in the m-th subfield of one field when the PDP is driven. As shown in FIG. 3, each subfield is divided into the initialization period, the address period, the sustain period and the erase period.

The initialization period is set for erasing the wall charges in all the discharge cells (initialization discharge) so as not to be influenced by the discharge generated prior to the m-th subfield (influence of the accumulated wall charges). In the example of the driving waveforms in FIG. 3, a higher voltage (initialization pulse) is applied to the scan electrode 5 than the data electrode 11 and the sustain electrode 4 to cause the gas in the discharge cell to discharge. As a result, electric charges generated by the discharge are accumulated on the wall surface of the discharge cells in order to nullify the potential difference among the data electrodes 11, the scan electrodes 5 and the sustain electrodes 4. Therefore, on the surface of the surface layer 8 around the scan electrodes 5 and on the surface of the MgO powder layer 16, negative wall charges are accumulated as the wall charges. On the other hand, positive wall charges are accumulated on the surface of the phosphor layers 14 around the data electrodes 11 and the surfaces of the surface layer 8 and the MgO powder layer 16 around the sustain electrodes 4. These wall charges cause a given value of wall potential between the scan 5 and data 11 electrodes as well as between the scan 5 and sustain 4 electrodes.

The address period (write period) is for addressing the discharge cells that are selected according to image signals divided into subfields (specifying the discharge cells to light or not). In this period, a lower voltage (scan pulse) is applied to the scan electrodes 5 than to the data electrodes 11 or the sustain electrodes 4 in order to light the intended discharge cells. More specifically, a voltage is applied between the scan 5 and data 11 electrodes in the same polar direction as the wall potential, as well as between the scan 5 and sustain 4 electrodes in the same polar direction as the wall potential, and thus, the address discharge (write discharge) is generated. As a result, negative charges are accumulated on the surface of the phosphor layers 14, on the surface of the surface layer 8 around the sustain electrodes 4, and on the surface of the MgO powder layer 16. In addition, positive charges are accumulated as the wall charges on the surface of the surface layer 8 around the scan electrodes 5 and on the surface of the MgO powder layer 16. Thus, a given value of the wall potential between the sustain 4 and scan 5 electrodes is generated.

The sustain period is set to sustain the discharge by extending the lighting period of each discharge cell specified by the address discharge so as to keep luminance according to a gradation level. In this period, in the discharge cells that have the wall charges, a sustain discharge voltage pulse (e.g. a rectangular waveform pulse of approximately 200 V) is applied between a pair of the scan electrode 5 and the sustain electrode 4 in such a manner that the voltage pulse between the pair of the scan electrode 5 and the sustain electrode 4 is out of phase with each other. Thus, the AC voltage is applied between the display electrode pairs so that a sustain pulse discharge is generated in the addressed discharge cells every time when the polarities reverse at the electrodes.

Due to the sustain discharge, in the discharge space, resonance lines having wavelengths of 147 nm are emitted from the excited Xe atoms, and molecular lines of 173 nm are emitted from the excited Xe molecules. Thus, these resonance lines and molecular lines are radiated to the surface of the phosphor layers 14, and converted into visible light. Thus, the image is displayed on the screen. The ON-OFF combinations of the subfields of red, green and blue colors enable an image to be displayed in multiple colors and gradations. Note that in the discharge cells in which the wall charges are not accumulated on the surface layer 8, the sustain discharge is not generated, and the discharge cells display black images.

In the erase period, an erase pulse of a declining waveform is applied to the scan electrodes 5. Thus, a discharge is generated in order to erase the wall charges.

(Structure of Protective Layer 17)

The protective layer 17 in the PDP 1 is made up of the surface layer 8 and the MgO powder layer 16. The surface layer 8 is disposed on the dielectric layer 7, and the MgO powder layer 16 is disposed on the surface layer 8.

The surface layer 8 is an MgO thin film with a thickness of approximately 1 μm formed on the dielectric layer 7 using the heretofore-known thin-film processing method such as the vacuum deposition method or the ion plating method. Note that the surface layer 8 does not need to be made solely of MgO but may be made of a metal oxide material including at least one of MgO, CaO, BaO, and SrO.

The MgO powder layer 16 is formed by evenly distributing the MgO particles 16*a* having a relatively even distribution of particle diameter, and setting the distributed MgO particles 16*a*. The MgO particles 16*a* have halogen atoms (fluorine atoms) in a certain range at and in a vicinity of the surface. It is thought this is, for example, due to some of the halogen atoms substituting oxygen atoms, causing an MgF2 crystal structure to exist in parts of the MgO crystal structure. The majority of such halogen atoms exist in each of the MgO particles 16*a* in an area close to the surface and at the surface. More specifically, the majority of the halogen atoms exist at the surface or in an area within a range of 4 nm from the surface toward the core of the MgO particle.

Investigating the amount of MgO particles 16*a* to cover the surface layer 8, the inventors found that it is preferable to cover the surface layer 8 with MgO particles at a projected area ratio of 1.0% or greater with respect to the surface layer 8. However, the present invention is not limited to this, and the MgO particles 16*a* may be cover an arbitrary area or areas of the surface layer 8 at a predetermined rate. Alternatively, a number relatively large MgO particles 16*a* (a range of approximately several through to several hundred MgO particles 16*a*) may be provided on the surface layer 8 in each discharge cell.

In the PDP 1 having the described MgO powder layer 16, the MgO particles 16*a* having an increased secondary electron emission coefficient γ due to the halogen atoms at and in the vicinity of the surface are distributed on the surface layer 8 such that the MgO powder layer 16 faces into the discharge space 15. Therefore, when the MgO particles 16*a* receive ultraviolet rays due to discharge occurring in the discharge space 15 when the PDP is being driven, secondary electrons are emitted abundantly from the surface of the MgO particles 16*a* into the discharge space 15. As a result, the firing voltage in the initial stage of driving the PDP 1 can be kept low as with conventional techniques, and in addition, discharge can commence more favorably and discharge delay can be suppressed.

Here, the MgO powder layer 16 is formed in the PDP 1 not by providing a large amount of MgO particles 16*a* on the surface layer 8, but by distributing the MgO particles 16*a* across the surface layer 8, and keeping the rate of coverage of the surface layer 8 by the MgO particle layer 16 relatively low. With this manner of distribution and relatively low coverage rate, the front panel 2 is ensured an appropriate visible transmittance, and discharge delay is sufficiently suppressed. As a result, the PDP 1 exhibits superior image display performance.

Generally, increasing the secondary electron emission coefficient γ is effective in improving discharge delay. Known methods for increasing the secondary electron emission coefficient γ include those disclosed in Patent Documents 1 and 2. Such methods introduce an oxygen deficiency or a dopant in the crystal lattice to increase a localized level in an energy band. However, with such methods, the structure of the MgO film becomes unstable over time, causing the structure to deteriorate as the discharge time increases, and potentially causing discharge properties to change.

In view of such issues, with the method for manufacturing the MgO particles 16*a* of the present invention, various halides are used as a sintering agent (described later), and some of the oxygen atoms in the crystals are substituted with fluorine atoms (i.e., halogen atoms) as a result of the sintering. In contrast to the conventional methods of making a local level by means of an oxygen deficiency, the manufacturing method of the present invention forms a local level by controlling atomization in the crystals. This enables a stable crystal structure to be maintained over time, and also increases the secondary electron emission coefficient γ favorably and stably. Thus, an effect of improving discharge delay can be expected.

It should be noted that the stated effect of improving discharge delay by introducing halogen atoms is realized by controlling electron discharge from the surface of the MgO particles. In other words, since the secondary electron discharge is a physical phenomenon that occurs mainly in an extremely shallow area of the MgO particles, namely through to a depth of several hundred pm from the surface of the MgO particles, it is thought that the structure of the surface layer of the MgO particles is the major contributing factor to discharge delay properties. The present inventors arrived at the present invention with careful investigation focusing on this point, and in particular, made an innovation in the structure of the surface and the surface vicinity of the MgO particles.

In this way, the present invention obtains a certain effect by aggressively ensuring that halogen atoms remain in the MgO particles. As such the present invention has a different feature to the conventional technique (Patent Document 5), since the conventional technique simply uses halogen atoms as a flux in the baking process and halogen atoms remaining after firing are unfavorable.

It should be noted that although an example of using fluorine atoms as the halogen atoms is given in the present embodiment, another type of halogen atoms can be used, one example being chlorine atoms.

Furthermore, Japanese Unexamined Patent Application Publication No. 2006-202765 recites a structure of a protective layer that is an MgO crystal film including halogen atoms. The recited protective layer, however, has a structure that includes the halogen atoms uniformly at and in the vicinity of the surface of the of an MgO film that faces into the discharge space. This is different to the present invention that uses the MgO particles 16*a* in which the halogen atoms exist at and in the vicinity of the surface of each of the MgO particles 16*a*. Furthermore, given that the MgO particles 16*a* are provided in an arbitrary area or areas on the surface layer 8, the present invention has the advantage of enabling precise control of the quantity of halogen atoms used and where the halogen atoms are used. As such, the present invention has an advantage over the stated conventional technique in this sense also.

Furthermore, in the stated conventional technique, the MgO film is formed using an EB method, and by carrying out plasma processing for introducing fluorine atoms in a vacuum chamber. However, the manufacturing method of the stated conventional technique is not a practical method, and, in terms of aspects including cost, is thought to be remarkably poor in mass productivity. In contrast, since the MgO particles 16*a* of the present invention are manufactured by baking a magnesium oxide precursor to which a firing agent that includes halogen atoms has been added (described later), the MgO particles 16*a* can be manufactured using a conventional manufacturing facility. As such, the present invention has an extremely high advantage in terms of viability including manufacturing cost.

Second Embodiment

The following describes a PDP 1*a* of a second embodiment of the present invention, focusing on aspects that differ from the first embodiment.

Figure 4:
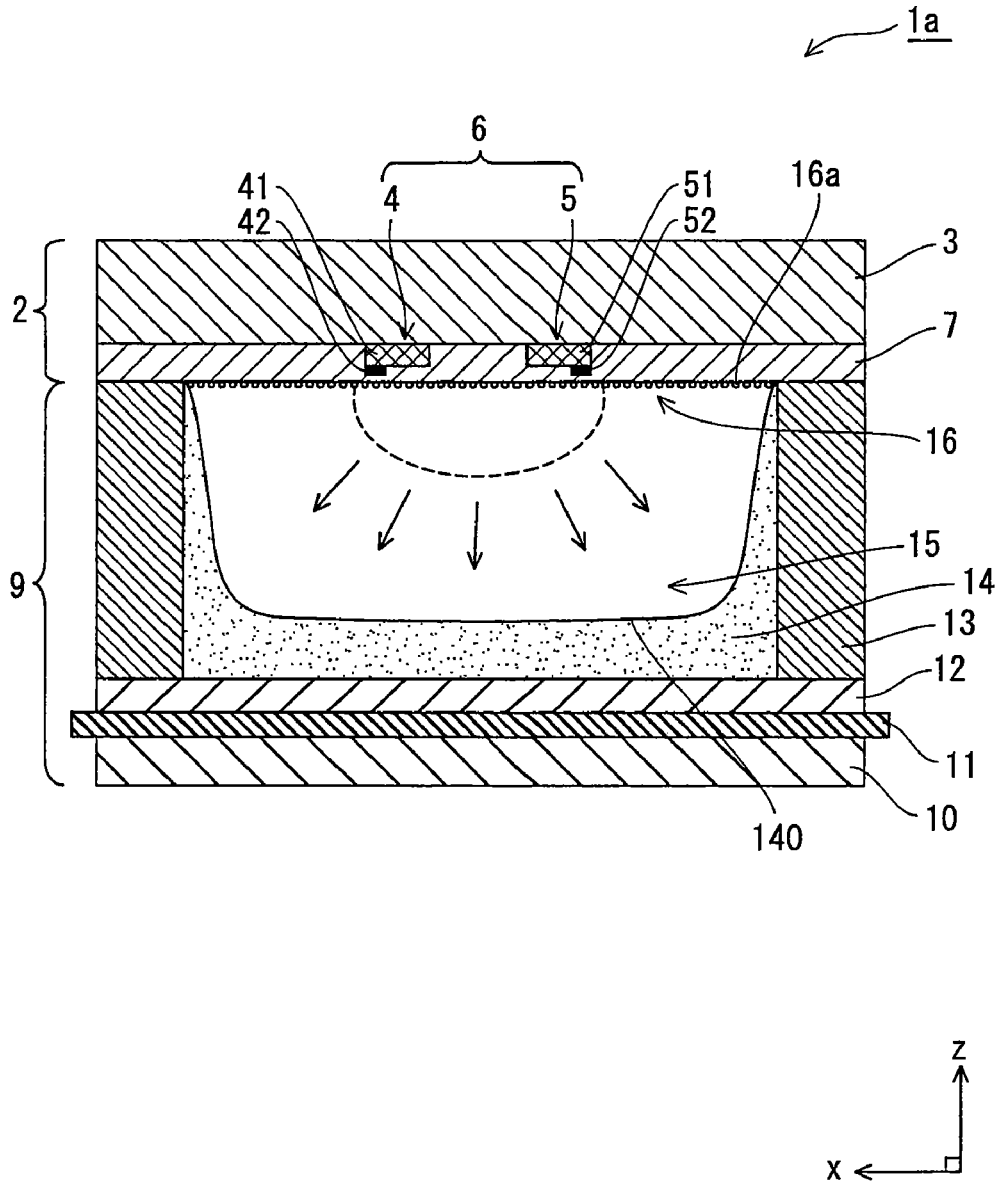
FIG. 4 is a cross-sectional view of the structure of a PDP of a second embodiment of the present invention.
Figure 5:
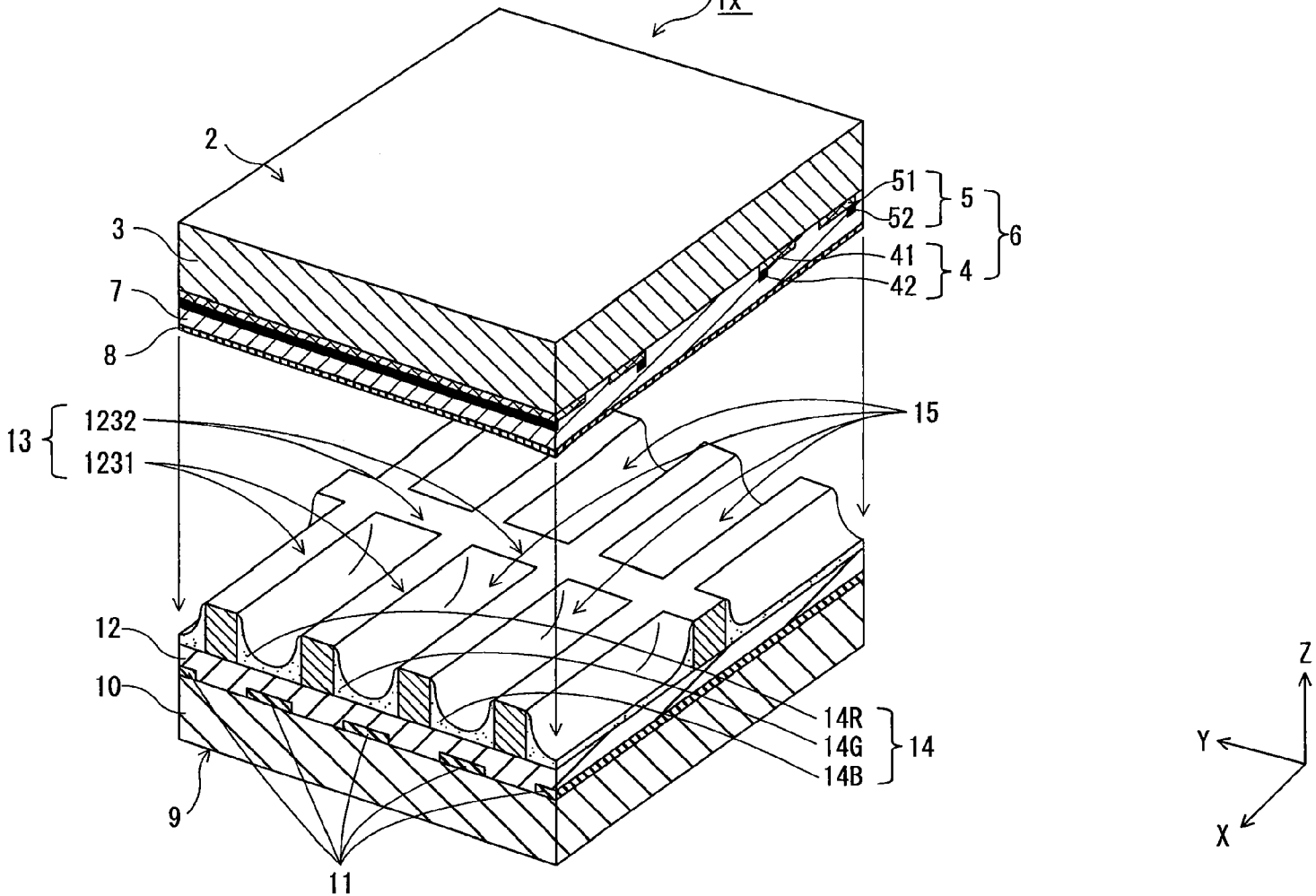
FIG. 5 shows an elevation of the structure of a general, conventional PDP.

FIG. 4 is a cross-sectional view showing the structure of the PDP 1*a* of the second embodiment.

The feature of the PDP 1*a* is that the protective layer is composed of the MgO powder layer 16 disposed directly on the dielectric layer 7, and the PDP 1*a* does not include a surface layer 8. The MgO particles 16*a* constituting the MgO powder layer 16 are the same as in the first embodiment.

The PDP 1*a* having the described structure has the same effects as the PDP 1. Namely, due to the MgO powder layer 16 on the surface of the dielectric layer, during driving of the PDP 1*a*, secondary electron discharge occurs abundantly toward the discharge space 15 from the MgO particles 16*a* because of the high secondary electron discharge coefficient γ of the MgO particles 16*a*. This suppresses the firing voltage Vf as with the conventional techniques, and also suppresses discharge delay. Furthermore, keeping the coverage of the dielectric layer 7 by the MgO powder layer 16 relatively low ensures an appropriate transmittance of the visible light while also suppressing discharge delay. As a result, the PDP 1*a* exhibits superior image display performance.

Furthermore, since the PDP 1*a* is not provided with a surface layer, the process to form the surface layer 8 (thin-film processing such as the sputtering method, ion plating method, and electron-beam deposition method) is completely unnecessary. Consequently, due to the omission of the process, the PDP 1*a* has a great and effective advantage of reduced manufacturing cost.

<PDP Manufacturing Method>

The following describes the manufacturing method for the PDP 1 and the PDP 1*a* in accordance with each embodiment of the present invention. The difference between the PDP 1 and 1*a* is mainly the structure of the protective layer; other processes in the production of the PDP 1*a* are the same as in the production of the PDP 1.

(Manufacturing Back Panel)

On the surface of the back panel glass 10 made up of soda-lime glass with a thickness of approximately 2.6 mm, a conductive material mainly composed of Ag is applied with the screen printing method in a stripe pattern at a given interval to form the data electrodes 11 with a thickness of some micrometers (e.g. approximately 5 μm). The data electrodes 11 are made up of a metal such as Ag, Al, Ni, Pt, Cr, Cu, and Pd or a conductive ceramic such as metal carbide or metal nitride. The data electrodes 11 may be made of a composition of these materials, or may have a layered structure of these materials as necessary.

The gap between each two adjacent data electrodes 11 is 0.4 mm or less so that the PDP 1 has a 40 inch-screen in conformity with the NTSC or VGA specification.

Following that, a glass paste with a thickness of approximately 20 μm to 30 μm made of lead-based or lead-free low-melting glass or $SiO_2$ material is applied and on the back panel glass 10 and the data electrodes 11 in order and baked to form the dielectric layer 12.

Subsequently, the barrier ribs 13 are formed on the dielectric layer 12 as follows. The low-melting glass paste is applied on the dielectric layer 12 and baked. The paste is formed, using a sandblast method or a photolithography method, in a grid pattern separating a plurality of adjacent discharge cells (not illustrated) arranged in rows and columns.

After the barrier ribs 13 are formed, phosphor ink including one of red (R), green (G) and blue (B) phosphors commonly used for the AC PDP is applied to the lateral surface of each barrier rib 13 and on the exposed surface of the dielectric layer 12. The phosphor ink is then dried and baked to form the phosphor layers 14.

Following is an example of the chemical composition of the applicable phosphors of the red, green and blue.

Red phosphor—(Y, Gd) $BO_3$:Eu, $Y_2O_3$:Eu

Green phosphor—$Zn_2SiO_4$:Mn, $YBO_3$:Tb and (Y, Gd)$BO_3$:Tb

Blue phosphor—$BaMgAl_{10}O_{17}$:Eu

It is desirable that each phosphor (powder) has an average particle diameter of 2.0 μm.

The phosphor ink is manufactured by mixing, for example, 30 mass percent of blue phosphor 30 having an average particle diameter of 2 μm, 4.5 mass percent of ethycellulose having an mass average molecular weight of approximately 200,000, and 65.5 mass percent of butyl carbitol acetate. Furthermore, in order to improve adherence of the ink to the barrier ribs 30, the viscosity of the mixture is adjusted to be approximately 2000 to 6000 cps (2 to 6 Pas). The resultant phosphor ink is applied by, for instance, injecting between the barrier ribs 13 from nozzles of a diameter of approximately 60 μm using a pump, according to a known method such as a meniscus method or a line jet method. When applying the phosphor ink, the panel is moved in the longitudinal direction of the barrier ribs 13. Accordingly, the ink is applied in a stripe pattern on the panel. The ink is then baked for 10 minutes at 500° C., thus forming the phosphor layers 14.

This completes the back panel 9.

(Manufacturing Front Panel 2)

The display electrode pairs 6 are formed on the surface of the front panel glass 3, which is made of soda-lime glass and has a thickness of approximately 2.6 mm. The second embodiment adopts the printing method as an example of forming the display electrode pairs 6. However, the display electrode pairs 6 may be formed by a dye coat method, blade coat method or the like.

To begin with, on the front panel glass 3, transparent electrode materials such as ITO, $SnO_2$, and ZnO are applied in a given pattern such as a stripe pattern, and dried, thus forming transparent electrodes 41 and 51.

Meanwhile, a photosensitive paste is prepared by blending Ag powder and an organic vehicle with a photosensitive resin (photodegradable resin). The photosensitive paste is applied on the transparent electrodes 41 and 51, and the transparent electrode 41 and 51 are covered with a mask having an opening that matches the pattern of the bus lines. After a development process in which exposure is performed on the mask, the photosensitive paste is baked at a temperature of approximately 590° C. to 600° C. Thus, the bus lines 42 and 52 with a final thickness of some micrometers are formed on the transparent electrodes 41 and 51. Though the screen method can conventionally produce a bus line with a width of 100 μm at best, this photomask method enables the bus lines 42 and 52 to be formed as thin as 30 μm. Besides Ag, other metal material that can be used to make the bus lines 42 and 52 include Pt, Au, Al, Ni, Cr, tin oxide and indium oxide. Other than the above methods, the bus lines 42 and 52 can be formed by etching a film having been formed by the deposition method or the sputtering method.

Subsequently, a paste is prepared by mixing (i) lead-based or lead-free low-melting glass or $SiO_2$ powder whose softening point is 550° C. to 600° C. with (ii) organic binder such as butyl carbitol acetate. The paste is applied on the display electrode pairs 6, and baked at a temperature ranging from 550° C. to 650° C. Thus, the dielectric layer 7 with a final thickness of some micrometers to some tens of micrometers is formed.

(Method of Manufacturing MgO Particles 16*a* Including Halogen Atoms)

The MgO particles 16*a* included halogen atoms that are used for the MgO powder layer 16 are obtained by baking a material that is a mixture of a magnesium oxide precursor and a sintering agent.

The magnesium compound used for the magnesium oxide precursor may be at least one of magnesium hydroxide ($Mg(OH)_2$), magnesium carbonate ($MgCO_3$), magnesium alkoxide, magnesium nitrate, and magnesium acetate.

The halide used for the sintering agent may be at least one of, for instance, magnesium fluoride ($MgF_2$), magnesium chloride ($MgCl_2$), aluminium fluoride ($AlF_3$), calcium fluoride ($CaF_2$), lithium fluoride (LiF), and sodium chloride (NaCl). It should be noted that if an element other than magnesium remains in the MgO particles 16*a* after baking, this may lead to an adverse affect on the discharge properties, depending on which element the remaining element is. Therefore, a magnesium halide is most suitable as the sintering agent for the purpose of ensuring favorable discharge properties. In this way, different sintering agents can be used as appropriate.

The raw materials may be mixed either by wet blending using a solvent, or by dry blending using dry powder.

If the wet blending method is used, the solvent may be, but is not limited to being, (i) water, (ii) an alcohol such as ethyl alcohol, methyl alcohol, isopropyl alcohol, n-propyl alcohol, n-butoxy alcohol, sec-butoxy alcohol, or tert-butoxy alcohol, (iii) an acetate ester such as butyl acetate, ethyl acetate, methyl acetate, or 2-methoxyacetic acid ethyl, or (iv) a ketone such as acetone, methyl ethyl ketone, or methyl isobutyl ketone.

In the dry blending method is used, the raw materials may be blended in a ball mill, a medium agitation mill, a planetary ball mill, a vibration mill, a jet mill, a V-mixer or such commonly used in industry. It should be noted that large particles present in the raw materials may have an adverse affect on the discharge properties, and as such it is preferable to perform sorting to ensure uniform granularity.

Baking the powder mix composed of the MgO precursor and the sintering agent for 15 minutes to 10 hours at a temperature of 600° C. to 1800° C., preferably 900° C. to 1500° C., obtains the MgO particles 16*a*.

It is necessary to adjust the baking temperature and baking time appropriately depending on various conditions such as particle diameter or sorting conditions of the precursor used, the amount of sintering agent added, and the amount of the powder mix. Furthermore, the atmosphere in which the baking is performed can be controlled to be either an oxidative atmosphere or a reductive atmosphere, in order to obtain desired discharge properties. Depending on the amount of powder mix to be baked, it is preferable to subject the powder mix to a preliminary baking process before the main baking process, in order to improve the mixing homogeneity with the sintering agent.

The preliminary baking process consists of baking for 15 minutes to 5 hours in an atmosphere at 700° C. to 1000° C. However, as with the main baking process, the baking time and temperature must be adjusted appropriately depending on the aforementioned conditions. The powder obtained by the preliminary baking processing is disintegrated, mixed with the sintering agent, and the subjected to main baking process. The preliminary powder may be mixed with the sintering agent either by way of dry blending or wet blending. It should be kept in mind, however, that a solvent such as water that dissolves MgO cannot be used. The baking furnace used in the preliminary and main baking processes may be a furnace ordinarily used in industry, examples of such a furnace being a continuous furnace such as a pusher furnace, an electric batch furnace, and a gas furnace.

The MgO particles 16*a* obtained in the main baking process may be re-disintegrated in a ball mill, a jet mill or the like, and sorted as necessary, in order to adjust the grain size distribution and fluidity of the MgO particles 16*a*.

Generally, MgO particles manufactured using a gas-phase oxidation method are relatively varied in grain size, and therefore, in order to obtain favorable and even discharge properties, it is necessary to carry out a sorting process to select particles having a size that falls within a set range.

In contrast, however, the present invention uses the described MgO precursor baking method, not a gas-phase oxidation method. This precursor baking method enables the particle size distribution of the MgO particles to be controlled appropriately by selecting the type of precursor from among candidates (candidates having respective differences in terms of conditions such as type of material, particle diameter, and grain size), and appropriately controlling baking conditions (the necessary conditions for baking such as baking temperature, baking atmosphere and baking time). As a result, the MgO particles 16*a* obtained using the precursor baking method are more uniform in grain size than MgO particles obtained using a gas-phase oxidation method, and can be controlled such that their grain size falls within a set range (100 nm to 8 μm, or more preferably, a range of 500 nm to 1 μm).

For this reason, the use of the precursor baking method in the present invention basically eliminates the need to carry out a sorting process, and the MgO particles 16*a* obtained by the precursor baking processing can be used without being subjected to any further processes. The elimination of the sorting process simplifies the processes involved in manufacturing, and is extremely advantageous in terms of manufacturing efficiency and cost. Furthermore, since there is no need for a special apparatus as would be needed for a gas-phase oxidation method, the present invention has an advantage that the MgO particles 16*a* can be manufactured using a conventional, general ceramic powder manufacturing process. This contributes to the effective reduction of manufacturing costs.

The manufacturing method of the present invention obtains particles having a smaller specific surface (BET) compared to particles manufactured using a gas-phase oxidation method. A small specific surface means that the MgO particles 16*a* exhibit little unnecessary gas absorbency, and are thus highly anti-absorbent. Therefore, the manufacturing method obtains the MgO particles 16*a* that exhibit favorable electron emission performance and uniform discharge properties.

It should be noted that if there is an excessive flow of gas in the atmosphere in the baking furnace during the baking process (including the main baking processing and the preliminary baking process), the halogen component that has been added as the sintering agent will be baked away, reducing the concentration of halogen in the magnesium oxide particles that are the final product of the baking process. A reduced halogen concentration is an obstacle to the adjustment of the halogen concentration at the surface of the MgO particles. Therefore, it is preferable to take measures to prevent such baking away of the halogen component. One example of such measures is to put the material components into a melting pot made of highly pure alumina, and carry out the baking process in the baking furnace with the melting pot sealed appropriately using a lid or the like.

Furthermore, adding the halogen atoms to the MgO particles has advantages of improving crystallization of the MgO particles, and allowing a lower baking temperature. Conventionally, an MgO baking temperature of at least 2000° C. is generally used. However, the addition of the halogen atoms to the material allows the baking temperature to be lowered by approximately 500° C. (in other words, the baking temperature can be lowered to approximately 1500° C.).

<Element Analysis of Surface and Surface Vicinity of MgO Particles>

The quantitativity of the halogen elements at and in the vicinity of the surface in the HgO particles can be measured by X-ray Photoelectron Spectroscopy (XPS). XPS is a surface analysis method that irradiates the surface of a specimen with an x-ray having a known wavelength (e.g., Al Kα ray, energy value 1487 eV) to measure the energy of photoelectrons that escape from the specimen. Information pertaining to a depth of approximately 4 nm from the surface of the specimen can be selectively obtained. This technique makes the relative sensitivity factor of each element clear. The measurement of the element ratio of metal at the specimen surface by XPS can be said to be an established technique.

Note that "at and in the vicinity of the surface of an MgO particle" denotes the range measured by XPS, and is the area from the surface of an MgO particle to a depth of approximately 4 nm toward to the core of the MgO particle.

Given that, as described earlier, the secondary electron discharge properties of the MgO particles of the present invention are realized mainly by the properties of an extremely shallow area from the surface of the particle through to a depth of several hundred pm, the method of using XPS to analyze the properties of the particle is the optimal method.

As one example, if a commercially-available XPS measuring apparatus (a scanning x-ray photoelectron spectroscope analyzer Quantera SXM) is used, the atom ratio of fluorine (F) to magnesium (Mg) can be calculated from the peak intensity ratio (peak surface area ratio) caused by Mg2p and F1s. Therefore, it is possible to express the calculation results in units of atm % or the like. When calculating the atom ratio, it is possible to remove a background using a Shirley method, and to use a Gaussian function in peak fitting.

(Manufacturing Protective Layer)

Next, the protective layer is formed on the back panel. If the protective layer 17 of the first embodiment is to be formed, the surface layer 8 is formed on the dielectric layer 7 to have a final thickness of approximately 1 μm, using a commonly known thin film formation method such as a vacuum deposition method or an ion plating method using MgO material.

Note that the surface layer 8 may be composed of a material that is sputter resistant and has a superior secondary electron discharge coefficient γ. For example, the surface layer 8 may be composed of one or more the following alkaline earth metal oxides: CaO, SrO, BaO, and Mg.

Next, the manufactured MgO particles 16*a* containing the halogen atoms are applied to the surface of the formed surface layer 8 so as to set flatly, using a spray method, a static electricity application method, slit coating method, a doctor blade method or a die coat method. The method used to apply the MgO particles 16*a* is not limited to the stated methods, and may be any of the stated methods or another method. In view of manufacturing costs, a screen printing method is widely used in industry as a thin film formation technique. The screen printing method is superior in that the amount of MgO particles 16*a* applied can be easily controlled according to the solid content ratio of the ink used or the specifications of the screen mesh.

Note that the amount of MgO particles 16*a* applied can be determined based on the "cover rate". This cover rate is defined by a measured value of the amount of variation of in-line transmittance of the front panel (visible light) before and after the forming of the MgO powder layer 16.

This cover rate can be expressed as follows.

Cover rate(%)=(in-line transmittance light amount by the front panel before the MgO powder layer 16 is formed)/(in-line transmittance light amount by the front panel after the MgO powder layer 16 is formed)×100

After the MgO particles are applied to the surface layer 8, the solvent is dried and removed, to fix the MgO particles to the surface layer 8. As a result, the MgO powder layer 16 is formed, thus completing the protective layer 17 according to the first embodiment.

In order to form the protective layer in accordance with the second embodiment, on the surface of the dielectric layer 7, the MgO particles 16*a* are applied by the screen printing method or the spraying method. This results in the MgO powder layer being formed, The MgO particles 16*a* are fixed to the dielectric layer, and thus completes the protective layer according to second embodiment.

The front panel 2 is completed as a result of the protective layer being formed in the above process.

(Completion of PDP)

The front panel 2 and the back panel 9 are sealed together with use of a sealing member (frit glass) to seal outer edges front panel 2 and the back panel 9 together, such that the data electrodes 11 are orthogonal to the display electrode pairs 6.

Thereafter, the discharge space 15 is evacuated to a high vacuum of approximately $1.0\times10^{-4}$ Pa, thereby removing the atmosphere and impurity gas from the discharge space 15. In the discharge space 15, Xe mixed gas such as Ne—Xe-based, He—Ne—Xe-based, or Ne—Xe—Ar-based gas is enclosed as discharge gas at a given pressure (ordinarily, $6.7\times10^{4}$ Pa to $1.0\times10^{5}$ Pa). The concentration of the Xe gas in the mixed gas is in a range of 15% to 100%.

The PDP 1 or 1*a* is completed as a result of the above processes.

Note that although the front panel glass 3 and the back panel glass 10 are described as being made of soda-lime glass in the examples given, soda-lime glass is merely an example, and another material may be used.

<Measurement Evaluation Test>

Examples of the present invention (hereinafter referred to as "implementation example(s)" or "Imp Ex.") and comparison examples were manufactured, and subjected to performance evaluation tests. It should be noted that the structure of the implementation examples and the methods used in the performance evaluation tests by no means limit the present invention.

Comparison examples (also referred to as "Comp Ex.") 1 to 4 are specimens that each contain no fluorine and were baked at respectively different baking temperatures. The comparison example 1 has no $MgF_2$ added thereto (0.00 mol %), and was baked at 1000° C. Implementation examples 1 to 14 are specimens that each contain a predetermined amount of fluorine and were each baked at one of several baking temperatures.

The MgO precursor used in manufacturing the comparison examples 1 to 4 and the implementation examples 1 to 14 was magnesium hydroxide of 99.99% purity and having an average particle diameter of 3 μm. In the implementation examples 1 to 14, magnesium fluoride of 99.99% purity was also used as a sintering agent. These were measured into predetermined compositions, and wet blended with pure water using a planetary ball mill and zirconia beads. The mixture was dried, and the dry mixture was broken down with a mortar and pestle and then baked in a highly pure alumina pot.

As described, it is necessary to carry out a preliminary baking process when there is a large amount of mixture. However, the amount of mixture used in the comparison examples 1 to 4 and the implementation examples 1 to 14 was sufficiently small with respect to the ability of the baking furnace (i.e., the capacity and power of the baking furnace) that the preliminary baking process was not carried out. Each of the comparison examples 1 to 4 and the implementation examples 1 to 14 was manufactured under baking conditions of maintaining a maximum temperature of either 1050° C., 1100° C., 1200° C. or 1300° C. for 15 minutes.

Table 1 shows a list of the above synthesis conditions.

TABLE 1

List of Synthesis Conditions

| Baking Temp. | $MgF_2$ [mol %] | | | | |
|---|---|---|---|---|---|
| [° C.] | 0.00 | 0.10 | 0.25 | 0.50 | 1.00 |
| 1000 | Comp Ex. 1 | Imp Ex. 1 | Imp Ex. 6 | Imp Ex. 10 | Imp Ex. 13 |
| 1050 | Comp Ex. 2 | Imp Ex. 2 | Imp Ex. 7 | Imp Ex. 11 | Imp Ex. 14 |
| 1100 | Comp Ex. 3 | Imp Ex. 3 | Imp Ex. 8 | Imp Ex. 12 | — |

TABLE 1-continued

List of Synthesis Conditions

| Baking Temp. | $MgF_2$ [mol %] | | | | |
|---|---|---|---|---|---|
| [° C.] | 0.00 | 0.10 | 0.25 | 0.50 | 1.00 |
| 1200 | Comp Ex. 4 | Imp Ex. 4 | Imp Ex. 9 | — | — |
| 1300 | | Imp Ex. 5 | | | |

The dried MgO particles were ground in a ball mill, and sorted by being passed through a nylon mesh in order to remove large grains.

Next, using a screen printing method, an MgO powder layer was formed on front panel glass that has been prepared in advance. When forming the MgO powder layer, the ratio of the mix of MgO particles, solvent and resin was adjusted such that the cover rate was 4.5%. The MgO particles, solvent and resin were made into ink for screen printing using a three roll mill. After the MgO powder layer was formed, the front panel glass with the MgO powder layer formed thereon was dried at 100° C. for one hour, and then baked at 500° C. for three hours to remove organic components.

Using front panel obtained in this way, AC surface discharge PDPs (comparison examples 1 to 4 and implementation examples 1 to 14) were manufactured as described in <PDP Manufacturing Method>.

Discharge delay time of the completed PDPs was evaluated. The discharge delay was evaluated in the following way. An arbitrary pixel was selected in each PDP. A data pulse and a scan pulse were repeatedly applied to the pixel, and the time taken from when the pulses are applied until discharge occurs (i.e., discharge delay time) was measured 100 times (i.e., measured for each of 100 instances of the pulses being applied). The average of the maximum value and the minimum value of the measured discharge delay was calculated. The delay time was determined by a photosensor module receiving light emitted from the phosphor in response to discharge, and the waveforms of the applied pulses and the waveforms of the signal of the received light were observed using a digital oscilloscope.

The measured values were standardized with respect to a case that the discharge delay time of the comparison example 1 was assumed to be 100. The discharge delay time of each of the other PDPs was expressed as a relative value A. The smaller the relative value A, the shorter the discharge delay time was. The discharge delay was judged to have been effectively reduced if the relative value A of the discharge delay time was 40% or lower. The discharge delay was judged to have been extremely effectively reduced if the relative value A of the discharge delay time was 20% or lower.

The results of the evaluation using the described method are shown in Table 2. Table 2 shows the detected amount of F atoms standardized with respect to the detected amount of Mg atoms as a result of analyzing the composition of the MgO particles in the comparison example 1 to 4 and the implementation examples 1 to 14 of Table 1 using XPS.

TABLE 2

Discharge Delay Time Relative Value A and Amount of F to Amount of Mg

| | Baking Temp. [° C.] | $MgF_2$ [mol %] | Discharge Delay Time Relative Value A [%] | Amount of F to Amount of Mg [atm %] |
|---|---|---|---|---|
| Comp Ex. 1 | 1000 | 0.00 | 100 | 0.30 |
| Comp Ex. 2 | 1050 | | 74.9 | 0.44 |
| Comp Ex. 3 | 1100 | | 112.9 | 0.91 |
| Comp Ex. 4 | 1200 | | 48.5 | 0.76 |
| Imp Ex. 1 | 1000 | 0.10 | 9.6 | 7.79 |
| Imp Ex. 2 | 1050 | | 9.7 | 6.12 |
| Imp Ex. 3 | 1100 | | 11.3 | 8.42 |
| Imp Ex. 4 | 1200 | | 8.2 | 9.24 |
| Imp Ex. 5 | 1300 | | 20.3 | 6.53 |
| Imp Ex. 6 | 1000 | 0.25 | 8.6 | 15.94 |
| Imp Ex. 7 | 1050 | | 11.4 | 15.44 |
| Imp Ex. 8 | 1100 | | 9.8 | 15.82 |
| Imp Ex. 9 | 1200 | | 6.6 | 17.80 |
| Imp Ex. 10 | 1000 | 0.50 | 13.4 | 19.03 |
| Imp Ex. 11 | 1050 | | 13.9 | 19.30 |
| Imp Ex. 12 | 1100 | | 11.2 | 18.51 |
| Imp Ex. 13 | 1000 | 1.00 | 36.3 | 21.67 |
| Imp Ex. 14 | 1050 | | 25.1 | 21.99 |

The results in Table 2 show that a minute amount of F atoms was detected in comparison examples 1 to 4, despite comparison examples 1 to 4 being manufactured without being $MgF_2$ being added. The cause of this is unclear, but it is speculated that the cause lies in a nonstationary factor such as measurement error in the XPS method, F components emitted from the walls of the baking furnace, or F components that have been mixed in from the melting pot. This minute amount of F atoms detected in comparison examples 1 to 4 does not affect actual evaluation.

As is clear from Table 2, the relative value of the discharge delay time is reduced to 40% or less with respect to comparison example 1 in the implementation examples 1 to 14 of the present invention. In particular, the relative value is reduced to 20.3% or lower in the implementation examples 1 to 12, thus demonstrating an even more remarkable effect.

Based on the results shown in Table 2, it can therefore be said that a range of 6.12 atm % to 21.99 atm %, inclusive, of the amount of F to the amount of Mg is the optimum range to achieve an effect of reducing discharge delay. Furthermore, it can be said that a range of 6.12 atm % to 19.30 atm %, inclusive, is an even more preferable range.

In the comparison examples 1 to 4, the amount of F to the amount of Mg was less than 1.00 atm %. Of the comparison examples 1 to 4, improvement in discharge delay was seen to an extent in comparison examples 2 and 4, whereas no improvement in discharge delay was seen in the comparison example 3. These results show that some improvement in discharge delay can be obtained if the amount of F to the amount of Mg is less than 1.00 atm %. However, stable discharge properties are not obtained.

Next, several PDPs were manufactured based on the PDP found to have the most favorable test results in Table 2 (implementation example 9). Each of the PDPs manufactured based on implementation example 9 had a different cover rate of MgO particles on the surface layer. The cover rate in each of the PDPs was set to a desired value by adjusting the amount of MgO particles included in the ink for screen printing, or adjusting the number of times the screen printing was carried out. The overall manufacturing method for these PDPs was based on the described manufacturing method.

The cover rate in each of the PDPs based on implementation example 9 was within a range of approximately 0.1% to 30%, and the described discharge properties were evaluated. In addition, a PDP without an MgO powder layer (comparison example 5) was manufactured and evaluated. PDPs having an MgO powder layer composed of commercially available MgO particles manufactured according to gas-phase synthesis were also manufactured and evaluated (comparison examples 6, 7 and 8). The cover rate in each of the comparison examples 6, 7 and 8 was in a range of approximately 17% to 75%.

The evaluation of the discharge delay time was made based on a relative value B of discharge delay time with respect to the discharge delay time of the comparison example 5, which was assumed to be a relative value of 100. Here, it was judged that there was a some effect when the relative value B of the discharge delay time was 15% or lower. It was judged that an even more remarkable effect was achieved when the relative value B of the discharge delay was 5% or lower.

The results of this evaluation are shown in Table 3.

TABLE 3

Cover Rate and Discharge Delay Time Relative Value B

| Specimen No. | MgO | Cover Rate [%] | Discharge Delay Time Relative Value B [%] |
|---|---|---|---|
| Comp Ex. 5 | — | 0.0 | 100 |
| Comp Ex. 6 | gas-phase | 5.8 | 83.33 |
| Comp Ex. 7 | synthesis MgO | 47.5 | 18.62 |
| Comp Ex. 8 | | 75.0 | 8.26 |
| Imp Ex. 15 | $MgF_2$: 0.25 mol % | 0.1 | 34.62 |
| Imp Ex. 16 | Baking Temp: | 1.3 | 13.38 |
| Imp Ex. 17* | 1200° C. | 4.5 | 4.50 |
| Imp Ex. 18 | | 12.3 | 3.80 |
| Imp Ex. 19 | | 23.2 | 2.79 |
| Imp Ex. 20 | | 31.5 | 3.15 |

*identical to implementation example 9

It can be seen from Table 3 that improvement of discharge properties was seen in each of implementation examples 15 to 20 of the present invention, with implementation examples 17 to 20 showing particularly remarkable discharge properties.

On the other hand, sufficient improvement of discharge delay was not obtained in comparison examples 6 to 8 in which the MgO made with a gas-phase oxidation method was used. Looking at the example of comparison example 6, the relative value of discharge delay is 83.33% in the case of the cover rate being 5.8%. Note that although the discharge delay time was sufficiently reduced in comparison example 8 which had a cover rate of 75%, this structure is unfavorable as it gives rise to the following problem.

Generally, visible light from phosphor observed through the front panel is blocked in reverse proportion to the coverage rate, and therefore basically should be able to be made relatively small. Accordingly, although delay discharge is improved to an extent in the PDP of comparison example 8, luminosity is reduced due to the reduction in visible light emitted. This is unfavorable because of the possibility of an adverse affect on image display performance.

The present invention favorably prevents discharge delay despite a relatively low cover rate due to the use of the magnesium oxide powder layer formed of magnesium oxide particles that include halogen atoms. Therefore, the structure of the present invention ensures a favorable amount of visible light emission with a relatively low cover rate even if the discharge delay time is approximately the same or slightly lower than that in the comparison examples. As a result, the structure of the present invention achieves both a reduction in discharge delay time and favorable luminosity, and therefore the present invention is highly superior because it exhibits superior image display performance.

The described observations confirmed the superiority of the present invention over conventional PDPs.

INDUSTRIAL APPLICABILITY

A PDP of the present invention can be used as gas discharge panel technology capable of high-definition image display while being driven with relatively low voltage, such as in televisions in public transport, public facilities or in the home, or as a display device for a computer.

The invention claimed is:

1. A plasma display panel including a first substrate and a second substrate that face each other via a discharge space, and an electrode and a dielectric layer provided on a main surface of the first substrate that faces the second substrate, the first substrate and the second substrate being sealed together at edges thereof, wherein the first substrate has magnesium oxide powder located either directly or indirectly on a surface of the dielectric layer such that the magnesium oxide powder faces the discharge space, the magnesium oxide powder being composed of magnesium oxide particles that include halogen atoms, and a ratio of the halogen atoms to magnesium atoms in the magnesium oxide particles being in a range of 6.12 atm % to 21.99 atm %, inclusive, and the magnesium oxide powder has a projected area ratio of 1.0% to 31.5%, inclusive, with respect to the dielectric layer.

2. The plasma display panel of claim 1, wherein the ratio of the halogen atoms to the magnesium atoms is in a range of 6.12 atm % to 19.30 atm %, inclusive.

3. The plasma display panel of claim 1, wherein the plasma display panel further includes a surface layer on the surface of the dielectric layer, the magnesium oxide powder being located on a surface of the surface layer that faces the discharge space, the surface layer being made of at least one metal oxide selected from magnesium oxide, calcium oxide, barium oxide and strontium oxide.

4. The plasma display panel of claim 1, wherein the halogen atoms in each magnesium oxide particle exist at least in an area extending from a surface of the magnesium oxide particle through to a depth in a vicinity of the surface of the magnesium oxide particle.

5. The plasma display panel of claim 3, wherein the depth in the vicinity of the surface is a depth of 4 nm or less from the surface toward a core of the magnesium oxide particle.

6. The plasma display panel of claim 1, wherein the halogen atoms are one of fluorine atoms and chlorine atoms.

7. A manufacturing method for a plasma display panel, the manufacturing method comprising:

a magnesium oxide particle provision step of providing magnesium oxide particles on a surface of a dielectric layer, the dielectric layer being provided together with an electrode on a surface of the first substrate; and a sealing step of arranging the first substrate and second substrate such that the surface of the first substrate faces the second substrate, and sealing the first substrate and the second substrate together, wherein the magnesium oxide particles used in the magnesium oxide particle provision step are obtained by baking a material composed of a magnesium oxide precursor and a sintering agent, the sintering agent being at least one of magnesium fluoride, magnesium chloride, aluminium fluoride, calcium fluoride, lithium fluoride and sodium chloride, a ratio of the halogen atoms to magnesium atoms in the magnesium oxide particles is in a range of 6.12 atm % to 21.99 atm %, inclusive; and the magnesium oxide powder has a projected area ratio of 1.0% to 31.5%, inclusive, with respect to the dielectric layer.

8. A manufacturing method for a plasma display panel, the manufacturing method comprising:

a surface layer formation step of forming a surface layer on a surface of a dielectric layer, the dielectric layer being provided together with an electrode on a surface of the first substrate; and a sealing step of arranging the first substrate and second substrate such that the surface of the first substrate faces the second substrate, and sealing the first substrate and the second substrate together, wherein the manufacturing method further comprises, between the surface layer formation step and the sealing step, a magnesium oxide particle provision step of providing magnesium oxide particles on a surface of the surface layer that faces the second substrate, wherein, in the surface layer formation step, the surface layer is formed from at least one metal oxide selected from magnesium oxide, calcium oxide, barium oxide and strontium oxide, the magnesium oxide particles used in the magnesium oxide particle provision step are obtained by baking a material composed of a magnesium oxide precursor and a sintering agent, the sintering agent being at least one of magnesium fluoride, magnesium chloride, aluminium fluoride, calcium fluoride, lithium fluoride and sodium chloride, a ratio of the halogen atoms to magnesium atoms in the magnesium oxide particles is in a range of 6.12 atm % to 21.99 atm %, inclusive; and the magnesium oxide powder has a projected area ratio of 1.0% to 31.5%, inclusive, with respect to the dielectric layer.

* * * * *